US006808475B2

(12) United States Patent
Kehrbaum

(10) Patent No.: US 6,808,475 B2
(45) Date of Patent: Oct. 26, 2004

(54) ERGONOMIC COMPUTER WORKSTATION AND TREADMILL COMBINATION

(76) Inventor: John M. Kehrbaum, 536 S. Euclid Ave., #6, Pasadena, CA (US) 91101-3262

( * ) Notice: Subject to any disclaimer, the term of this patent is extended or adjusted under 35 U.S.C. 154(b) by 128 days.

(21) Appl. No.: 10/265,501

(22) Filed: Oct. 7, 2002

(65) Prior Publication Data

US 2004/0067821 A1 Apr. 8, 2004

(51) Int. Cl.[7] ..... A63B 22/02
(52) U.S. Cl. ..... 482/54
(58) Field of Search ..... 412/51, 54, 52, 412/70, 71, 72, 904

(56) References Cited

U.S. PATENT DOCUMENTS 3,874,657 A * 4/1975 Niebojewski ..... 482/104
4,300,761 A * 11/1981 Howard ..... 482/57
4,431,181 A * 2/1984 Baswell ..... 482/38
5,704,879 A * 1/1998 Watterson et al. ..... 482/54
5,813,947 A * 9/1998 Densmore ..... 482/51
5,984,839 A * 11/1999 Corkum ..... 482/54
6,224,516 B1 * 5/2001 Disch ..... 482/54
6,508,744 B1 * 1/2003 Carolus ..... 482/54
6,520,890 B2 * 2/2003 Hsu ..... 482/54
2003/0134718 A1 * 7/2003 Kim

* cited by examiner

*Primary Examiner*—Nicholas D. Lucchesi
*Assistant Examiner*—Tam Nguyen

(57) ABSTRACT

An article of furniture (10) including a plurality of wall panels (12, 14, 16, 18, 20, 22) enclosing a work-exercise space (40) with shelving (46) mounted therewithin for supporting a computer (48) at a height enabling a standing operator to work ergonomically. A foldup treadmill (58)is stored in the space under the shelving (46) when not in use and folded down onto the floor in front of the computer enabling simultaneous exercising on the treadmill and ergonomic operation of the computer.

10 Claims, 5 Drawing Sheets

ERGONOMIC COMPUTER WORKSTATION AND TREADMILL COMBINATION

BACKGROUND

1. Background of the Invention

The present invention relates generally to a computer workstation, and, more particularly, to a stand-alone computer workstation in the form of a furniture item having a treadmill located therein in such manner that ergonomic simultaneous exercising on the treadmill and working at the computer may be accomplished by an individual.

2. Description of Related Art

The benefit of exercise to the well-being of a human has been clearly established. Moreover, the need for periodic physical exercise is a generally accepted fact and it has been found that greater need for exercise exists where an individual is involved as a normal part of gainful employment to spend long hours of most days at a relatively sedentary work activity and which is typically associated with high stress. Exemplary of such work activity is that which regularly is associated with computer operation where the basic employment confines the individual to a relatively small area (e.g., adjacent a keyboard and within view of the computer monitor) and where the work aims usually require precision analysis of data and making entries as well as managing data in accordance with certain software or in connection with one or more work objects. Still further, it has been shown that the most beneficial exercise for an individual has been found to be that which produces considerable muscular movement resulting in elevated circulatory activity (so-called aerobic exercise).

A particularly beneficial form of aerobic exercise is that achieved in the use of a treadmill which consists basically of a continuous belt movably mounted onto rollers and the exerciser walks on the belt causing it to move while the user remains in approximately the same position. A customized amount of exercise is achieved by angularly adjusting the apparatus to the floor to produce a corresponding modification of force required to move the belt on which the user stands. Also, in most models the belt can be selectively tensioned to increase or decrease the required force to move it thereby accommodating individuals having a wide range of physical strength and stamina. Moreover, since a treadmill stays in one place during exercise and can be used in a manner leaving the hands free, it is readily adaptable for simultaneous exercising implementation while performing a large number of employment tasks such as operating a computer.

SUMMARY OF THE INVENTION

It is a primary object and aim of the present invention to combine a computer workstation and treadmill into a unitary furniture arrangement enabling simultaneous exercising use of the treadmill while ergonomically operating the computer to perform predetermined work functions.

Another object in accordance with the previous object is the provision of means for converting the computer workstation and treadmill into a unitary closed structure which is secure when unattended.

Yet another object is the provision of an article of furniture as in the previous objects which can be readily incorporated into a workplace structure such as a so-called "cubicle" including a plurality of upstanding wall panels affixed to a floor surface and typically having an open top.

DESCRIPTION OF A PREFERRED EMBODIMENT

Figure 1A:
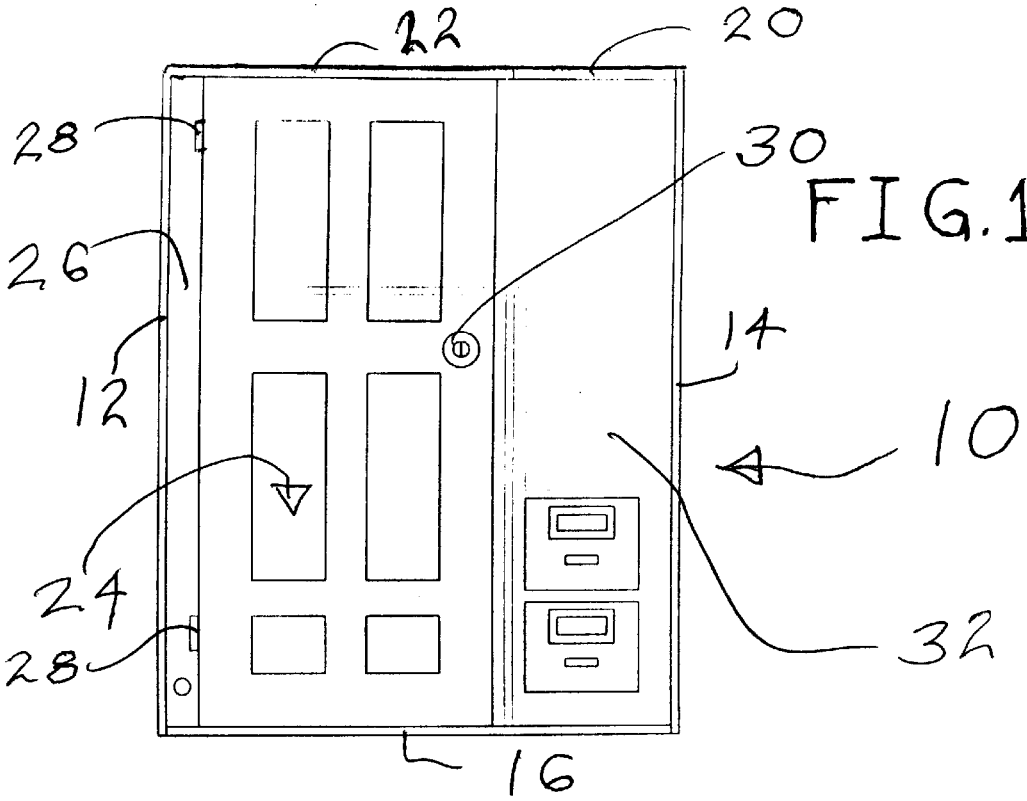
FIGS. 1A and 1B are, respectively, front and side views of the stand alone workstation furniture of the present invention shown in closed condition.
Figure 1B:
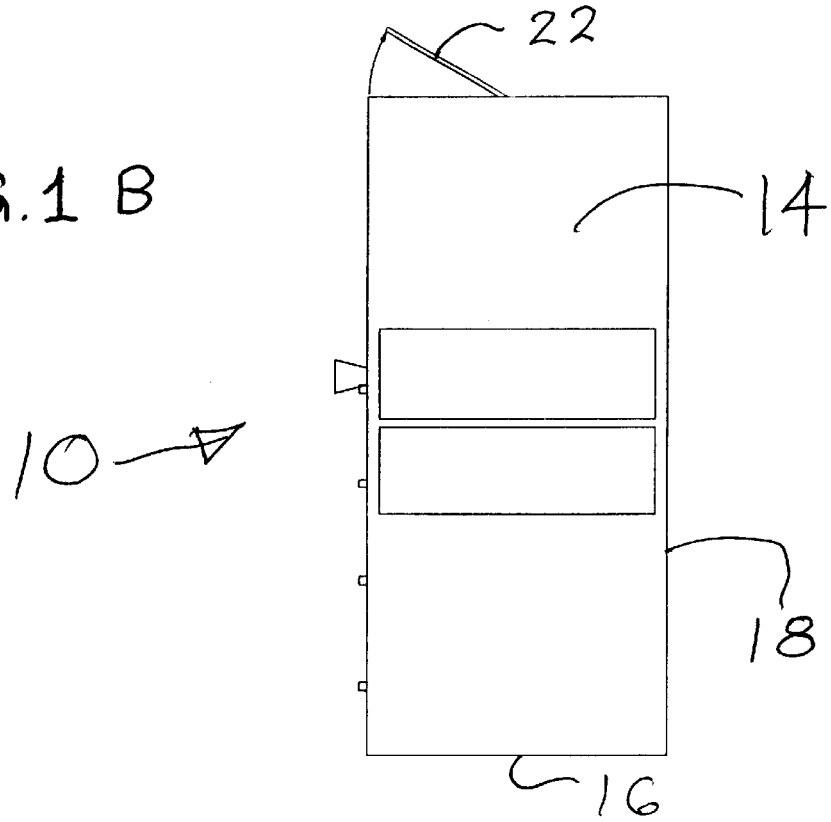

Turning now to the drawing and particularly FIGS. 1A and 1B, the workstation furniture of the present invention enumerated generally as 10 is shown in stand alone condition and closed. The overall external geometry is that of a parallelepiped including first and second side walls or panels 12 and 14, a bottom panel 16, a back wall or panel 18, a fixed top panel 20, and a movable panel 22 which can be selectively swung to a closed position (FIG. 1A) or to an open position as in FIG. 1B. The front of the invention includes a door 24 connected to a door jamb 26 by hinges 28 for conventional swinging motion from closed to open condition. A handle 30 is also provided and can accommodate a locking device (not shown) for the door. A fixed front panel 32 extends from the bottom to the top of the unit and can be optionally modified to accommodate filing cabinets or other office accessories, as desired.

Figure 2:
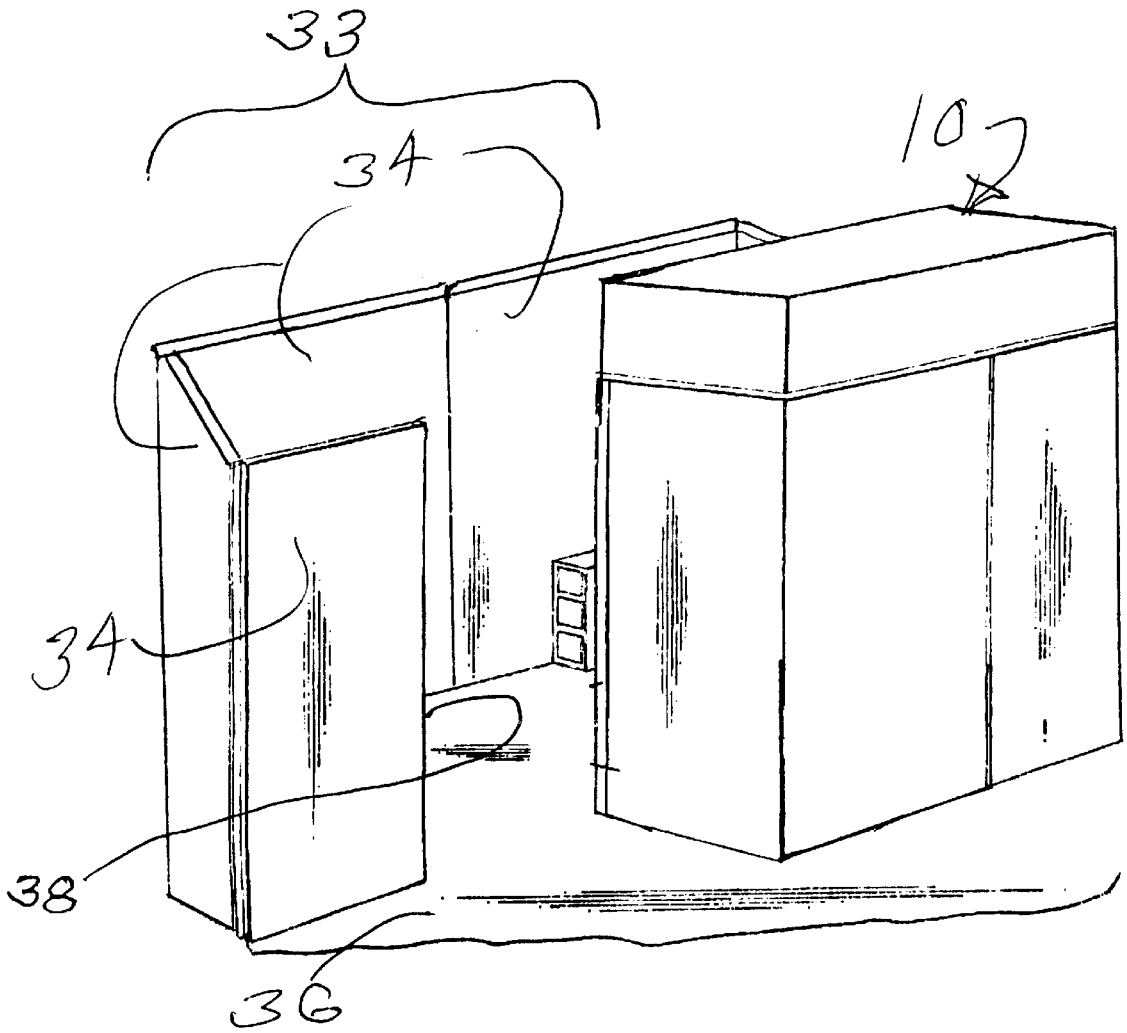
FIG. 2 is a perspective view of the invention shown located within a cubicle workplace arrangement.

Turning now to FIG. 2, a workplace arrangement 33 of the so-called "cubicle" variety with which the invention be advantageously employed includes a plurality of upstanding wall panels 34 each having one end secured to a generally horizontal floor surface 36 of the building structure. The panels have their lateral edges connected together in predetermined manner to enclose an "office" space for an individual to work, and additional space for accommodating work equipment, while typically leaving the top open. A number of workplace arrangements 33 can be set up in spaced apart relation separated by corridors formed by adjacent cubicle wall panels. Entrance to assigned space of a cubicle workplace is typically provided through an open doorway 38, for example.

Although a considerable range of work purposes and equipment can be assigned to cubicle workplaces as described above, for present purposes, the workplaces are especially contemplated for accommodating employees working at computers which typically restricts a computer operator to a limited work area adjacent the computer and tends to be of a generally sedentary character.

Figure 3:
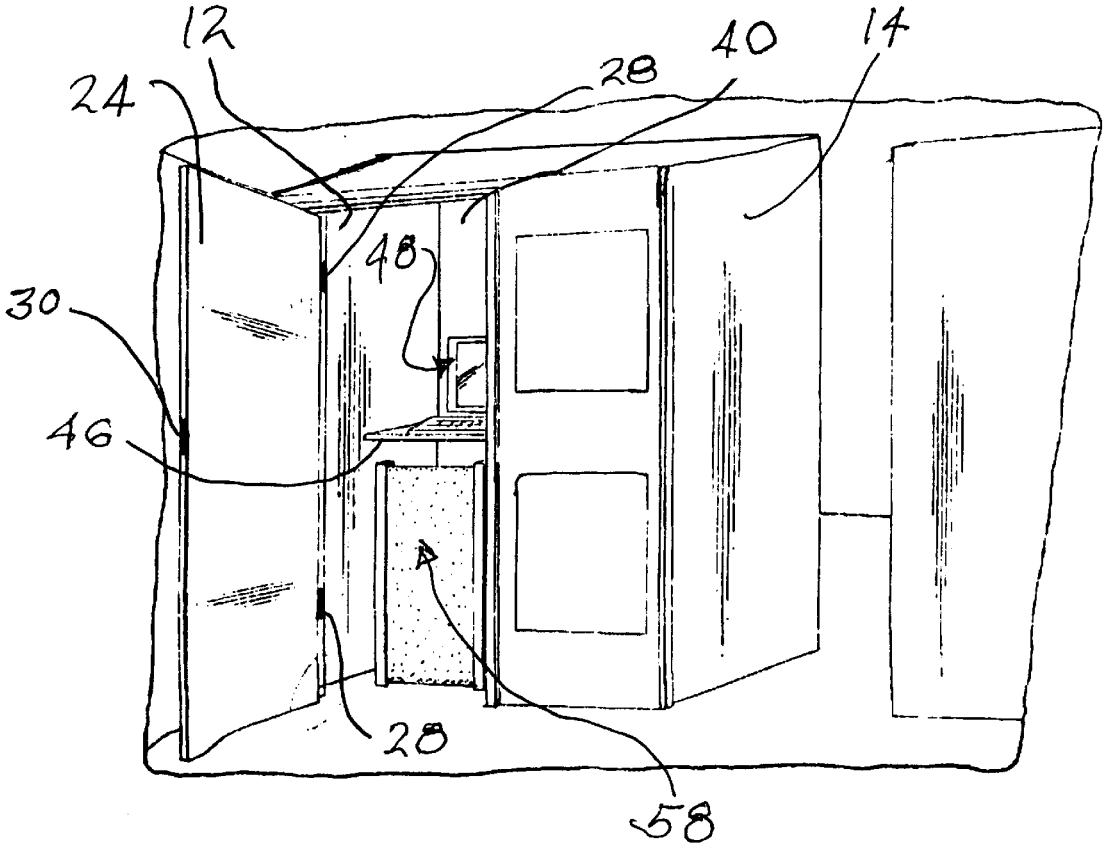
FIG. 3 depicts in perspective the workstation furniture with the access door open.
Figure 4:
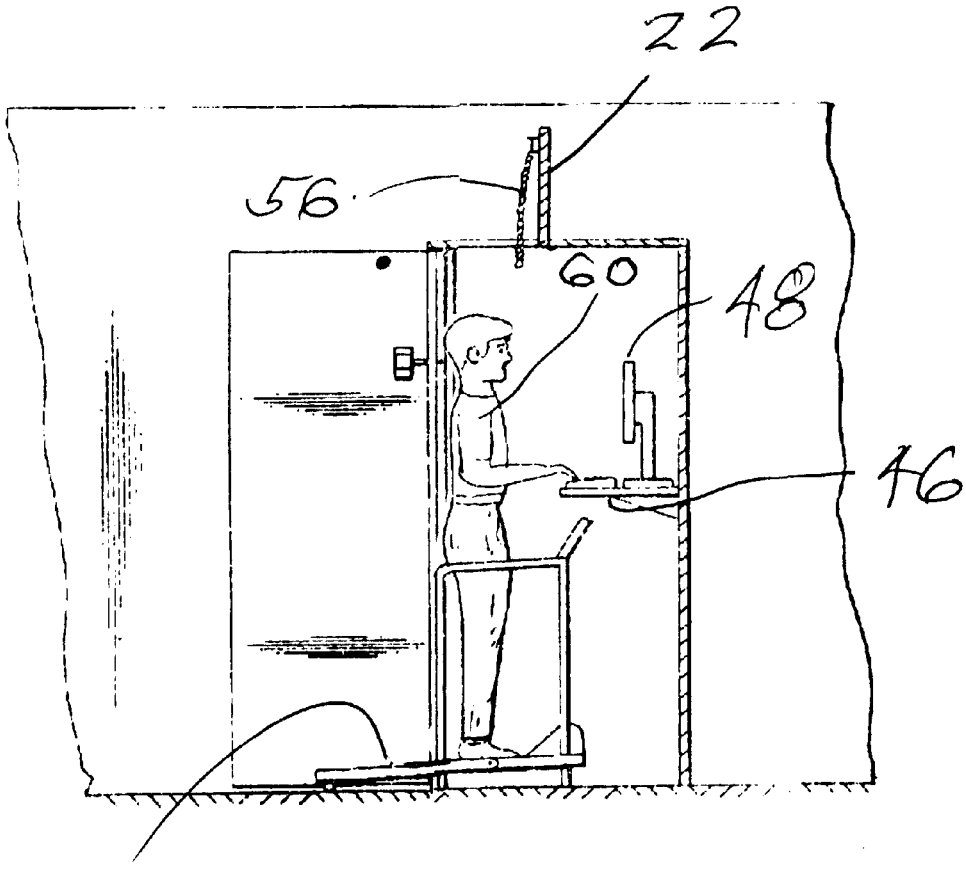
FIG. 4 shows in elevation an individual operating a computer while standing on an exercise treadmill which are coactively associated with the invention.
Figure 5:
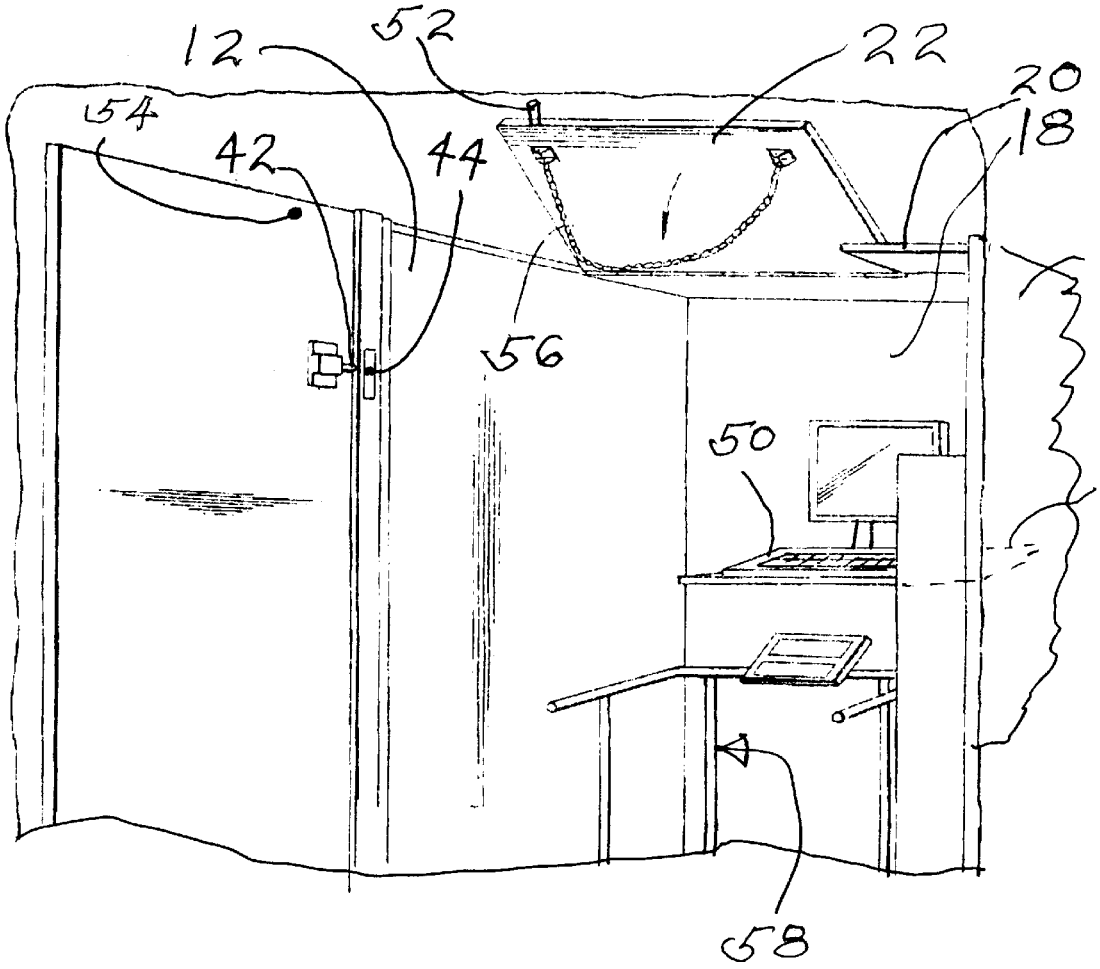
FIG. 5 depicts the described workstation furniture opened up disclosing the interior.

For the ensuing description of internal details of the invention, reference is now made to FIGS. 3-5. The already described walls or panels 12 through 22 are edge connected to enclose a work-exercise space 40. Also, these panels have their lower edges secured to a bottom panel or wall 16 which, in turn, rests upon the floor surface 36 of the building structure.

Also, as can be seen best in FIG. 5, on the inner closed lateral edge portion of the door 24 there is provided a locking post 42 which is received within an opening 44 formed in the doorjamb 26 on the door closing which reduces the possibility of unauthorized access to the computer, a treadmill to be described, and other valuable materials and equipment which may be located within the work-exercise space 40.

Still referring primarily to FIG. 5, shelving 46 is slidingly mounted to the inner surfaces of the unit walls or panels for supporting a computer 48, keyboard 50 and possibly other computer accessories (e.g., printer, scanner). When the shelving 46 is moved forwardly toward the space 40 open side and door the maximum amount, the computer and keyboard are in position for use. On the other hand, when the shelving 46 is moved inwardly of the space 40 to the inner maximum, the computer and keyboard are, in effect, stored within the space 40.

The movable top panel 22 is hinged to the to a fixed top panel 20 enabling swinging movement of panel 22 forwardly into full covering relation over the work-exercise space 40. On closing the door 24 with the panel 22 in covering relation to the space 40, a locking pin 52 extending outwardly away from the forward edge of panel 22 is received within an opening 54 in the inner upper edge portion of the door serving to lock them together.

Alternatively, the movable top panel 22 may be swung upwardly and back uncovering the top of space 40 to prevent hindering computer work (FIGS. 4 and 5). A chain 56 has its opposite ends connected to what is the lower major surface of panel 22 when it is closed to aid in manipulating the top panel to either closed or open positions, as the case may be.

A treadmill 58 that can be most advantageously employed with the invention is of the foldup style which when being used for exercise extends generally parallel to the floor surface 36 and bottom panel 16 on which it rests. However, when the treadmill is not being used, it folds up into a generally vertically extending package and is stored in the space remaining when the shelving 46 with computer/keyboard is moved to the rear of space 40 (FIG. 5). As already noted, when it is desired to use the treadmill, it is merely folded down onto the floor surface 36 and panel 16, and used in the customary manner. It is important to note that on the treadmill assuming a floor based position, an empty space exists under the shelving which can receive the legs (especially the knees) of the operator-exerciser 60 during foldable treadmill use without risk of injury (FIG. 4). Also, as can be seen in FIG. 4, the operator while exercising is ergonomically positioned for working on the computer thereby reducing unnecessary fatigue and minimizing the possibility of carpal syndrome injuries developing.

Although the invention has been described in connection with a preferred embodiment, it is to be understood that those skilled in the appertaining arts may effect modifications that come within the spirit of the invention as described and within the ambit of the appended claims. For example, the relative arrangement (e.g., mirror arrangement) of computer, treadmill and filing cabinets can be modified should it better fit within an existing office plan. Also, additional shelves, filing cabinets, book shelves and other office type working surfaces can be incorporated within the workplace furniture of the invention. A sliding keyboard/mouse shelf can be utilized to accommodate both right- and lefthand operators. Still further, passive ventilation can be adopted to enable the computer to remain powered during off-work hours for backup without the buildup of heat within the device when it is fully closed and secured. All of these modifications can be adopted and the ergonomic work/exercise capabilities of the invention still available.

What is claimed is:

1. An article of furniture for an office or other workplace, comprising:

two side panels, a bottom panel, and a fixed top panel wherein the panels' edges are connected to form an enclosed work exercise space while leaving one side and part of the top of the enclosed space open;

a swingable top panel connected to the fixed top panel for selectively closing off the top open part of the enclosed space;

a door selectively manipulable to close off the open side of the enclosed space;

a computer support shelving secured to certain wall panels within the enclosed space at an upward location for supporting computer equipment while also accommodating a standing computer operator; and an exercising treadmill including a continuous belt, wherein the treadmill can be folded up while resting on the floor panel for storage in the space enclosed by the wall panels.

2. An article of furniture as in claim 1, in which the computer support shelving is located upwardly at a predetermined height from the bottom panel enabling, ergonomic operation of the computer by an operator while in a standing position and while exercising on the treadmill.

3. An article of furniture as in claim 2, in which the support shelving is movable in a first direction toward the open side to a position for combined computer operation and exercising on the treadmill, and movable in a second direction further into the space enclosed by the wall panels for storage of the treadmill.

4. An article of furniture as in claim 1, in which the swingable top panel is connected to the fixed top panel via a hinge such that said swingable top panel can swing from a position enclosing the top of the enclosed space to a further position exposing the top of the enclosed space to provide an individual operator posture adjustment and access for ambient lighting of the enclosed space.

5. An article of furniture as in claim 4, in which the door is connected via a hinge to a jamb adjacent the open side providing swinging movement of the door from a first position covering the panel space open side to a second position free from covering the open side.

6. An article of furniture as in claim 5, further comprising a locking pin, affixed to an edge of said swingable top panel, wherein said pin has an outer end portion that is received within an opening in the door such that the swingable top panel can close the top opening of the enclosed space when the door is closed to lock the door and swingable top panel together.

7. An article of furniture as in claim 5, further comprising a locking post, affixed to the door, and receivable within an opening in the adjacent door jamb upon closing the door for locking the door and jamb to each other.

8. An article of furniture as in claim 1, wherein said article is resistingly incorporated within a cubicle workstation constructed of wall panels.

9. An article of furniture as in claim 4, in which a length of chain has first and second ends connected to the swingable top panel and the intervening portion of the chain hangs downwardly under the action of gravity.

10. In a workstation of the cubicle variety generally formed by a plurality of floor-mounted upstanding wall panels, an article of furniture enabling simultaneous ergonomic computer work function operation and treadmill exercising, comprising:

first and second side panels, a bottom panel, and a fixed top panel, wherein the edges of the panels are connected to form a unitary structure enclosing a work-exercise space while leaving a top and one side of the space open;

a computer support shelving located within the work-exercise space and vertically mounted for enabling a standing and exercising computer operator to ergonomically operate a computer, said shelving being movable from a forward maximum enabling ergonomic computer operation to a maximum position inwardly of the work-exercise space providing additional empty storage space toward the open side of the work-exercise space;

a door mounted for lateral swinging movement from a first position closing the work-exercise space to a second position leaving the space accessible for work and exercise;

a swingable top wall panel having an edge connected to an edge of the fixed top panel for movement from a first position closing off the open top of the work-exercise space to a second position leaving the open top of the work-exercise space accessible;

a length of flexible material having its opposite ends secured to a bottom surface of the swingable top wall panel, wherein the material is suitable for grasping to move the panel to the first position to close off the open top of the work-exercise space;

a locking pin secured to said swingable top panel, wherein the pin has an end portion slidingly received within an opening in the door when the top panel is in the first position and the door is in the first position; and a locking post secured to the door and extending into an opening in an adjacent door jamb to lock the door when the door is in the first position adjacent door jamb to lock the door when the door is in the first position.

* * * * *